US005101360A

United States Patent [19]

Bennett

[11] Patent Number: 5,101,360

[45] Date of Patent: Mar. 31, 1992

[54] METHOD AND APPARATUS FOR AUTOMATICALLY ADJUSTING THE CROWN HEIGHT FOR A SLIP FORMING PAVER

[75] Inventor: Brian A. Bennett, Ricketts, Iowa

[73] Assignee: Gomaco Corporation, Ida Grove, Iowa

[21] Appl. No.: 509,187

[22] Filed: Apr. 16, 1990

[51] Int. Cl.[5] ..... G06F 15/20; E01C 19/22

[52] U.S. Cl. ..... 364/505; 404/84.8; 404/96; 404/119

[58] Field of Search ..... 364/474.05, 505; 404/84, 96, 119

[56] References Cited

U.S. PATENT DOCUMENTS

| | | | |
|---|---|---|---|
| Re. 33,025 | 8/1989 | Matsumoto et al. | 364/424.01 X |
| 3,009,400 | 11/1961 | Gerber et al. | 404/119 |
| 3,905,715 | 9/1975 | Dale | 280/840 X |
| 4,289,421 | 9/1981 | Sampey et al. | 404/119 X |
| 4,609,303 | 9/1986 | Shumaker | 404/96 X |
| 4,788,773 | 12/1988 | Palsgard et al. | 33/333 |
| 4,918,608 | 4/1990 | Middleton et al. | 364/562 X |
| 5,044,820 | 9/1991 | Prang | 404/84 |

*Primary Examiner*—Parshotam S. Lall
*Assistant Examiner*—Edward R. Cosimano
*Attorney, Agent, or Firm*—Henderson & Sturm

[57] ABSTRACT

An apparatus for automatically slip forming concrete having a movable frame for moving in a first direction over concrete to be formed into a desired shape. The movable frame has a longitudinal centerline generally aligned with or parallel to the first direction. A crown forming structure is attached to the frame for selectively producing a desired crown on the concrete being so formed. The crown forming structure includes a left segment pivotally attached on an inner portion thereof, along an axis generally near to and aligned with or parallel to the longitudinal centerline of the movable frame. The crown forming structure also includes a right segment pivotally attached on an inner portion thereof, along an axis generally near to and aligned with or parallel to the longitudinal centerline of the movable frame. A transition adjusting device is provided for selectively raising and lowering said inner ends of the right and left segments for controlling the crown forming structure. A computer control is also provided for automatically adjusting the position of the transition adjusting device for causing a smooth transition between two crown heights at two respective positions of the movable frame as the movable frame moves in the first direction thereof.

9 Claims, 2 Drawing Sheets

METHOD AND APPARATUS FOR AUTOMATICALLY ADJUSTING THE CROWN HEIGHT FOR A SLIP FORMING PAVER

TECHNICAL FIELD

The present invention relates generally to a paving apparatus capable of adjusting the crown on a slab of pavement being formed and more particularly to a computer controlled paving apparatus of the aforementioned type for automatically adjusting the position of the concrete forming apparatus for producing a smooth transition between two desired crown heights between two respective positions of the aforementioned apparatus as it moves from one position to the next.

BACKGROUND ART

Concrete roads on a level section of terrain often have a crown, i.e., the center is higher than the, sides, so water will run off instead of staying on the road. On curves and other non-level roads, the crown is often eliminated. When sections of a road are slip formed, it often becomes desirable to form a smooth transition between a section of road with one crown height (e.g. a flat road section) and another section of road with a different crown height (e.g. a curved road section).

In the past, when it was desired to go from one crown height to the next, the operation was essentially a manual operation. There was a pointer pointing to a ruler to indicate the crown height of the pan, another such pointer to indicate the crown height of the dowel bar inserter (DBI) and a third pointer to indicate the present crown height of the screed. The operator on the ground had access to a switch for each transition adjuster for the pan, DBI and screed respectively adjacent to each respective pointer/ruler. The operator on the ground watching the pointers then had to exercise his judgment as to when and how much to raise or lower each transition adjuster to cause a smooth transition from one crown height to the next. When the switch was activated either up or down, the crown height was changed by manually moving a switch which actuated transition adjusters to move up or down.

Quite commonly, the operator would go too far up or down with the transition adjuster, too fast or not fast enough, thereby creating a bump in the concrete formed, thereby creating what in the industry is referred to as a "must grind". These "must grind" conditions create a considerable expense to the company forming the concrete slab because it is extremely expensive to grind off these bumps in the concrete.

Consequently, there is a need to produce paving equipment which will eliminate the need for personal supervision and eliminate the human error commonly found in this prior art manner of adjusting between one crown height and the next.

SUMMARY OF THE INVENTION

The present invention relates generally to an apparatus for automatically slip forming concrete having a movable frame for moving in a first direction over concrete to be formed into a desired shape. The movable frame has a longitudinal centerline generally aligned with or parallel to the first direction. A crown forming structure is attached to the frame for selectively producing a desired crown on the concrete being so formed. The crown forming structure includes a left segment pivotally attached on an inner portion thereof, along an axis generally near to and aligned with or parallel to the longitudinal centerline of the movable frame. The crown forming structure also includes a right segment pivotally attached on an inner portion thereof, along an axis generally near to and aligned with or parallel to the longitudinal centerline of the movable frame. A transition adjusting device is provided for selectively raising and lowering said inner ends of the right and left segments for controlling the crown forming structure. A computer control is also provided for automatically adjusting the position of the transition adjusting device for causing a smooth transition between two crown heights at two respective positions of the movable frame as the movable frame moves in the first direction thereof.

An object of the present invention is to provide an improved concrete slip forming apparatus.

Another object of the invention is to provide a control for a slip forming machine for automatically adjusting the transition between two crown heights for producing a smooth transition therebetween.

A further object of the invention is to provide a computer control for a machine of the aforementioned type which will synchronize movement of a pan, dowel bar inserter and screed so that all three will all be set at precisely the same place along a section of concrete being slip formed.

Other objects, advantages and novel features of the present invention will become apparent from the following detailed description of the invention when considered in conjunction with the accompanying drawings.

BEST MODE FOR CARRYING OUT THE INVENTION

Figure 1:
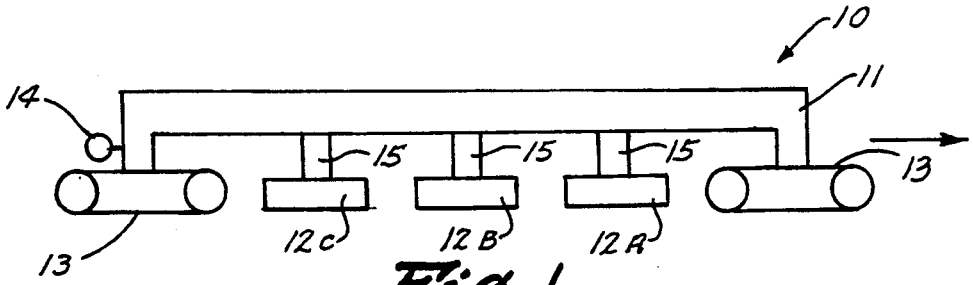
FIG. 1 is a side elevational schematic view of a slip forming paver constructed in accordance with the present invention.

Referring now to the drawings wherein like reference numerals designate identical or corresponding parts throughout the several views, FIG. 1 shows a slip form paving machine (10) constructed in accordance with the present invention. The machine (10) has a frame (11) which is moved either forwardly or rearwardly by tracks (13), as is conventional in this art.

Figure 2:
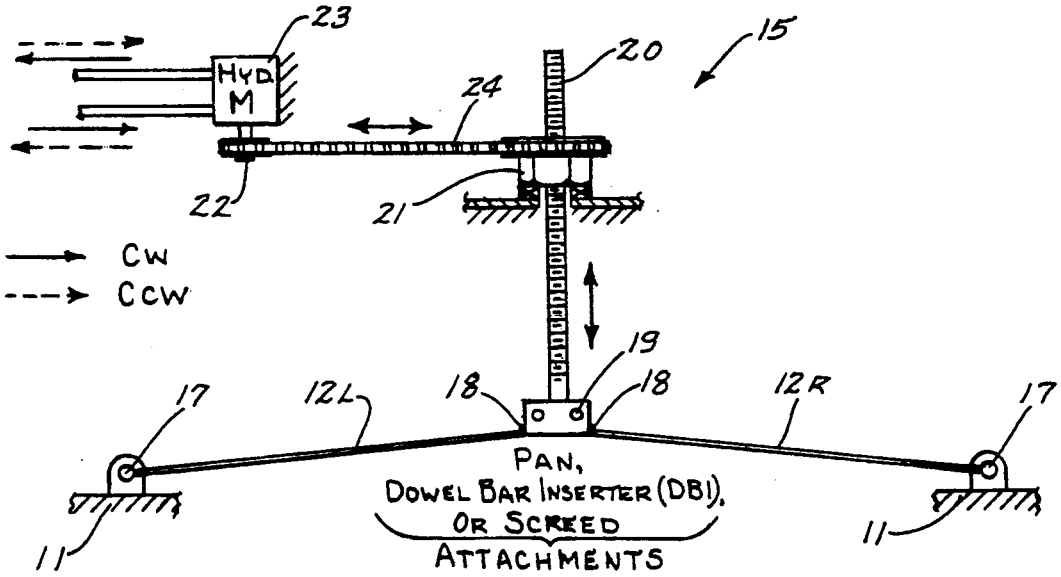
FIG. 2 is a simplified view of a transition adjuster for adjusting the crown height on a pan, dowel bar inserter or screed for the machine of FIG. 1.

Shown schematically is a pan (12A) which is pivoted in the middle and can be moved up or down by transition adjuster (15) as shown in FIG. 2. A dowel bar inserter (DBI) (12B) is also shown schematically in FIG. 1 and is also pivoted in the middle up or down by transition adjuster (15) as shown in FIG. 2. Behind the dowel bar inserter is also a screed (12C) which smooths out the concrete after the dowel bars have been inserted as is well known in this art, and this screed is also pivoted in the middle and is movable up or down by the transition adjuster (15), which is just like the other transition adjusters previously mentioned and as shown in FIG. 2.

Figure 3:
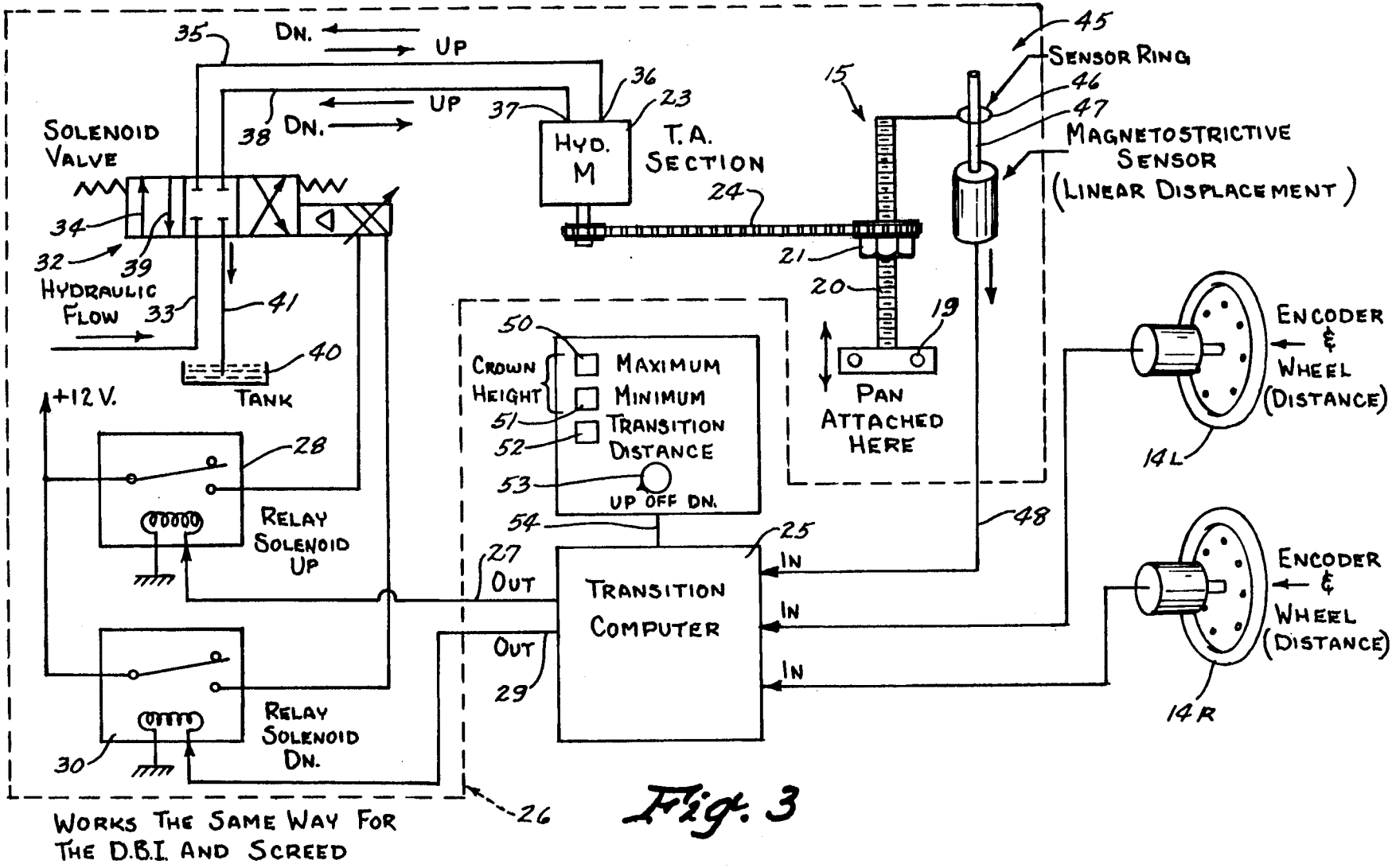
FIG. 3 is a schematic view of the control system for the machine shown in FIG. 1.

FIG. 2 shows a transition adjuster (15) of the type used in FIGS. 1 and 3. The members (12L and 12R) in FIG. 2 are representative of the left and right sides respectively of anyone of the pan (12A), dowel bar inserter (12B) or screed (12C). The left side (12L) is pivotally attached at the outer edge to the frame (11) at pivotal joint (17) and at the inner edge by pivotal joint (18) to a structural member (19). Similarly, the right side (12R) is pivotally attached at the outer edge of the frame (11) on the right side by another pivotal joint (17) and at the inner end by another pivotal joint (18) to the structural member (19). Slip joints (not shown) can be included for accommodating the fact that sides (12L) and (12R) will need to somewhat lengthen or shorten respectively as they are raised and lowered.

Threaded shaft (20) extends through a mating threaded member (21). This internally threaded member (21) is allowed to rotate with respect to the frame (11), but it is not allowed to move up or down with respect to the frame. A sprocket is rigidly attached to the internally threaded member (21) so that, as the sprocket rotates, the internally threaded member (21) will rotate accordingly. Similarly, a sprocket is rigidly attached to the output shaft (22) of a reversible hydraulic motor (23). Chain (24) extends around the sprocket on the shaft (22) and around the sprocket attached to the internally threaded member (21) so that as the hydraulic motor rotates, the shaft (22), and ultimately the chain and sprocket arrangement, will rotate the internally threaded member (21).

When the internally threaded member (21) is rotated in one direction, the threaded shaft (20) is pulled upwardly, thereby raising structural member (19) and members (12L) and (12R). This, of course, will increase the crown height, noting that (12L) and (12R) can be either the pan, the dowel bar inserter (12B), the screed, or any other structure for forming and maintaining the top surface of concrete during the slip forming process.

When the internally threaded member (21) is rotated in an opposite direction, this will lower the shaft (20), the structural member (19) and consequently will reduce the crown height. It is of course understood that the structural member (19) is rigidly attached to the threaded shaft (20) so that the shaft (20) does not rotate with respect thereto. The hydraulic motor (23) is of a conventional type having two ports. When the hydraulic oil under pressure enters one of the ports and exits the other port it rotates the shaft (22) in one direction and reversing the flow between the two ports causes the hydraulic motor (23) to rotate in an opposite direction.

FIG. 1 shows an encoder (14) operatively attached to the moving track (13). This encoder (14R) is also shown in FIG. 3. A substantially identical encoder (14L), as shown in FIG. 3, and attaches to the rear track on the left side of the machine (10). It will be understood, of course, that these encoders could be on the front tracks if so desired. Each of the encoders (14L) and (14R) generates a signal whenever the respective track moves a predetermined distance, measured in counts such as one rotation of the encoder wheel.

These encoders (14L) and (14R) also are capable of distinguishing between forward and rearward motion, for example by using two signals on each encoder wheel 90° out of phase. Each time the encoder travels one unit forward or backward, a corresponding signal is sent to the transition computer (25).

The transition computer (25) keeps track of the number of counts generated by the encoders (14L) and (14R). The computer (25) also automatically adds the computer counts from the signals from encoders (14L) and (14R) and divides the sum in half for the purpose of indicating the distance in units that the center of the machine has traveled forwardly or rearwardly. This is important in circumstances where the machine is traveling around a curve where one track will move a farther distance than the other track.

The dashed box (26) shows the actuating mechanism for the transition adjuster (15) as well as the transition adjuster itself. An out signal line (27) leading from the transition computer (25) leads to a relay (28) and an out signal (29) leads to a relay (30). When the relay (28) is actuated by receiving a signal out through line (27) of the transition computer (25), a solenoid operated valve (32) is moved to the right, thereby causing hydraulic oil under pressure to flow from inlet line (33), through line (34) in the valve, and out line (35) into port (36) in the hydraulic motor. That hydraulic oil under pressure will rotate the hydraulic motor (23) in such a direction to cause the internally threaded member (21) to also rotate in one direction which will pull the threaded rod (20) and thereby the pan (12A), dowel bar inserter (12B) or screed (12C) (depending upon which one it is attached to) upwardly to increase the crown height. This oil under pressure through the hydraulic motor (23) will, of course, exit through port (37), line (38), valve passageway (39), and will go back to the sump (40) through line (41).

When the signal out from the transition computer (25) through line (27) stops, the solenoid valve will return to its neutral position, as shown in FIG. 3, thereby stopping the flow to and from the hydraulic motor (23). The solenoid valve (32) is spring biased to its neutral position.

When the computer sends an out signal through the line (29) to relay (30), this will actuate the solenoid valve (32) to move to the left, thereby causing flow from the line (33) to the line (38), through the hydraulic motor (23) and out line (35) to line (41), and ultimately to the sump (40). This will, of course, cause the hydraulic motor (23) to rotate in the opposite direction from what was just previously described, and this will rotate the internally threaded member in an opposite direction, thereby lowering the rod (20) and thereby lowering the crown height of the respective pan (12A), dowel bar inserter (12B), or screed (12C) to which rod (20) is attached.

Likewise, when the signal out through line (29) stops, the solenoid valve will return to its neutral position, as shown in FIG. 3, thereby stopping flow to and from hydraulic motor (23).

A sensor (45) is provided for indicating the position of the threaded shaft (20) and thereby is an indication of the crown height of the pan (12A), the dowel bar inserter (12B), or the screed (12C), depending upon which one it is attached to. The sensing device (45) has a sensor ring (46) rigidly attached to the threaded shaft and this sensor ring extends around a shaft (47) connected to the magnetostrictive sensor (45) for sensing linear displacement. An input line (48) extends from the magnetostrictive sensor (45), through line (48), to the transition computer (25). Consequently, the transition computer (25) will always know the crown height, preferably in two one-thousandths of an inch.

It is to be understood that the pan (12A) has one of the transition adjusters (15) and the control (26) therefore attached thereto, as does the dowel bar inserter (12B) and the screed (12C). This means, of course, that each one of these control devices (26) will have a pair of output lines (27) and (29) connected thereto from the transition computer (25).

Assuming for the sake of this explanation that the system shown in FIG. 3 is attached only to the pan (12A), the operation would be as follows. The operator would set a maximum crown height by using the thumbwheel (50) and the minimum crown height by setting the thumbwheel (51). The transition distance would be set by using the thumbwheel (52). A control knob (53) is utilized to select whether the transition adjuster is to transition upwardly, to transition downwardly or to be shut off entirely. This information is fed into the transition computer (25) through line (54).

Figure 4:
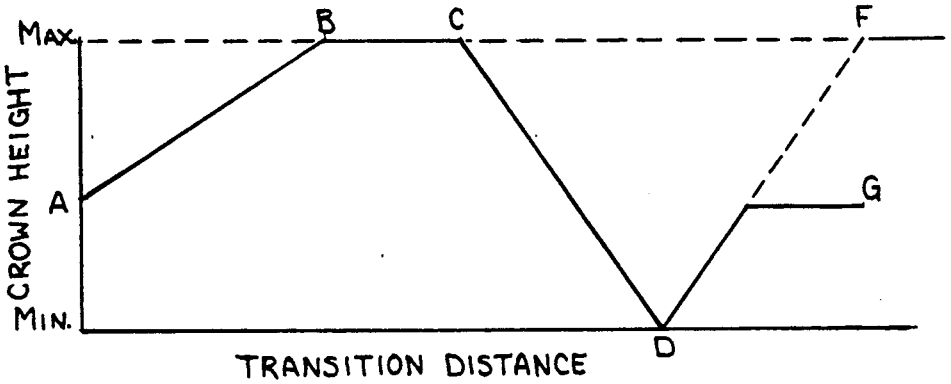
FIG. 4 is a chart tracing the crown height for one example of the use of the present invention.

Referring now to FIG. 4, the operation of the device will be explained initially just by considering the control of the crown height of the pan (12A). If the crown height is currently at position A and the control knob (53) is utilized to indicate that an upward transition is desired, in order for the machine to automatically transition from point A to point B, the crown height setting for point B is made on thumbwheel (50) and the transition distance for B is set by thumbwheel control (52).

Since the control (53) is set to "up", the computer will compute the difference, preferably in tenths of an inch, between the crown height B and crown height A, which will indicate the number of steps of the transition. The crown height of position A will have been sensed by the sensor (45), which is the way that the computer knows the current crown height. The computer will then compare the current value of crown height A and the maximum crown height B and calculate the number of steps to be taken during the transition. Based on the transition distance set by thumbwheel switch (52), the computer will convert this distance into encoder counts. Based on the transition distance set by thumbwheel (52), which corresponds to the forward distance of movement between the points A and B, and the number of transition steps upwardly of the crown height between the points A and B, the computer will compute the number of encoder counts necessary between each transition upwardly.

As the machine (10) moves forwardly, the transition computer will receive the information from the encoders (14L) and (14R) and, as explained above, will compute how far the center of the machine has moved forwardly in counts. Once the counts being tallied by the computer reaches the calculated number of counts for each transition to occur, a signal will be sent out through output line (27) to relay (28) and on to solenoid valve (32), which will turn the hydraulic motor in the proper direction to cause the transition adjuster (15) and its threaded shaft to move upwardly. It will continue to increase the crown height of the pan until the signal from the sensor (45) indicates that it has gone the necessary step upwardly, for example one-tenth of an inch, at which time the transition computer will discontinue the signal out to the relay (28). The computer will again start over to count the encoder counts for forward movement of the center of the machine (10) and the same process will occur over and over until such time that the machine has traveled the transition distance forwardly from point A to point B.

If it is desired to maintain the maximum crown height of point B for some transition distance, for example to point C, then the control knob (53) would be turned to the off position so that no changes to the transition adjuster (15) would be made as the machine moves forwardly from position B to position C.

If it is desired to transition from a maximum crown height at C to a minimum crown height at D, for example when transitioning from a level road which requires a height crown height for draining, to a curve which requires little if any crown height for drainage, the following process would be followed. The thumbwheel switch (51) would be set to correspond to the crown height at point D and the transition distance would be set to correspond between the distance that the machine will need to travel forwardly from position C to position D. The computer will then compare the current value of the crown height at C and the minimum crown height at D and calculate the number of transitions necessary when moving between these two crown heights. Based on the transition distance, converted into encoder counts, the computer will calculate how far the machine needs to travel in encoder counts between each step.

As the machine (10) moves forwardly, the computer will keep track of how many counts the center of the machine has traveled forwardly, and when these counts add up to the calculated amount between transition steps, the computer will send the signal out through output line (29) to actuate the relay (30). This will cause the solenoid valve (32) to ultimately cause the internally threaded member (21) to move in an opposite direction to thereby lower the pan. This transition will continue until the sensor (45) indicates that one transition step downwardly, such as one-tenth of an inch, has occurred, at which time the output signal through line (29) is discontinued. As the machine (10) continues to move forwardly from position C to position D, the transition adjuster (15) will be adjusted downwardly at the appropriate time corresponding to the number of encoder counts previously calculated, to thereby cause a smooth transition of the crown height between the points C and D.

It is also significant to note that the operation can be interrupted if desired. For example, if the operator decides to transition between the points D and F, the thumbwheel switch (50) would be set to correspond to the desired crown height at F and the operation would proceed precisely as described above with respect to points A and B; however, if at point E the operator decides to maintain the current crown height instead of continuing to increase it to the value of the crown height set at F, the knob (53) is merely utilized to turn the transition equipment off and then, as the machine moves forwardly, for example to the position G, the crown height would simply be maintained at the level that it was at E when the equipment was turned off. Once at position G, it will, of course, be understood the equipment can be used to transition the crown height up or down just as in the examples previously given.

If for some reason the machine needs to back up, the encoders (14L) and (14R), in conjunction with the computer (25), will keep track of this process by subtracting the number of counts in the backing up process from the number of counts already counted. This becomes important because when the machine is again moved forwardly, the transition can continue with the computer (25) knowing precisely where is at all times.

Another aspect of this invention is that the computer (25) will synchronize the action of the transition adjusters on the pan (12A), the dowel bar inserter (12B) and the screed (12C) so that as the machine (10) moves forwardly and the pan (12A) is adjusting its crown height beginning, for example at point A in FIG. 4, the transition adjuster for the dowel bar inserter will begin its transition also at point A and continue precisely along the same path to point B when traveling over the same territory that the pan has traveled. Similarly, when the screed gets to point A, its crown height will be adjusted over substantially the identical path that the pan and dowel bar inserter traveled when they passed over this same portion of the concrete. This, of course, will occur throughout any path that the crown height travels.

Obviously, many modifications and variations of the present invention are possible in light of the above teachings. It is therefore to be understood that, within the scope of the appended claims, the invention may be practiced otherwise than as specifically described.

I claim:

1. Apparatus for automatically slip forming concrete comprising:

a movable frame means for moving in a first direction over concrete to be formed into a desired shape, said movable frame means having a longitudinal centerline generally parallel to said first direction;

crown forming means attached to said frame for selectively producing a desired crown on the concrete being so formed, said crown forming means including a left segment pivotally attached on an inner portion thereof, along an axis generally parallel to said longitudinal centerline of said movable frame means, said crown forming means also including a right segment pivotally attached on an inner portion thereof, along an axis generally parallel to said longitudinally centerline of said movable frame means;

transition adjusting means for selectively raising and lowering said inner ends of said right and left segments for controlling said crown forming means;

a left encoder means for generating a first signal to indicate the distance the left side of said frame means has traveled;

a right encoder means for generating a second signal for indicating how far the right side of said frame means has traveled;

a first transition adjuster sensing means for generating a third signal for indicating the height of said transition adjusting means;

means for generating a fourth signal corresponding to the setting of a first crown height for said transition adjusting means;

means for generating a fifth signal corresponding to the setting of a second crown height for said transition adjusting means;

means for generating a sixth signal corresponding to the setting of the transition distance between said first and second crown heights of said transition adjusting means;

computer control means for automatically adjusting the position of the transition adjusting means for causing a smooth transition between two crown heights at two respective positions of said movable frame means as said movable frame means moves in said first direction in response to said first, second, third, fourth, fifth and sixth signals; and means for operably connecting said first, second, third, fourth, fifth and sixth signal generating means to said computer means.

2. The apparatus of claim 1 including computer software means for causing said computer control means to add the distances the right and left sides of the frame means has traveled and divide the result of said added distances by two in order to generate a distance that the center portion of the frame means has traveled.

3. The apparatus of claim 1 wherein said computer control means further includes means for using said current and desired crown heights of the crown forming means and the distance over which the transition from the current to the desired crown height is to occur by calculating the number of transitional steps desired to accomplish said transition, calculating the distance between each transitional step and causing said transition adjusting means to move one transitional step in a vertical direction each time the frame moves said calculated distance.

4. The apparatus of claim 1 including a second crown forming means attached to said frame for selectively maintaining said desired crown on the concrete being so formed, said second crown forming means including a left segment pivotally attached on an inner portion thereof, along an axis generally parallel to said longitudinal centerline of said movable frame means, said second crown forming means also including a right segment pivotally attached on an inner portion thereof along an axis generally parallel to said longitudinal centerline of said movable frame means;

a second transition adjusting means for selectively raising and lowering said inner ends of said right and left segments of said second crown forming means for controlling said second crown forming means, said second crown forming means being disposed behind said first crown forming means by a predetermined distance; and said computer control means including means for synchronizing the movement of said first and second transition means whereby said second crown forming means has the same crown height when it passes over the concrete being formed as the first crown forming means had at the time when it passes over the same portion of concrete.

5. The apparatus of claim 4 including a third crown forming means attached to said frame for selectively maintaining said desired crown on the concrete being so formed, said third crown forming means including a left segment pivotally attached on an inner portion thereof, along an axis generally parallel to said longitudinal centerline of said movable frame means, said third crown forming means also including a right segment pivotally attached on an inner portion thereof along an axis generally parallel to said longitudinal centerline of said movable frame means;

a third transition adjusting means for selectively raising and lowering said inner ends of said right and left segments of said third crown forming means for controlling said third crown forming means, said third crown forming means being disposed behind said second crown forming means by a predetermined distance; and said computer control means including means for synchronizing the movement of said first and third transition means whereby said third crown forming means has the same crown height when it passes over the concrete being formed as the first crown forming means had at the time when it passes over the same portion of concrete.

6. The apparatus of claim 4 wherein said second crown forming means comprises a dowel bar inserter.

7. The apparatus of claim 6 wherein said third crown forming means comprises a screed.

8. A method of slip forming concrete using the following apparatus:

a movable frame means for moving in a first direction over concrete to be formed into a desired shape, said movable frame means having a longitudinal centerline generally parallel to said first direction;

crown forming means attached to said frame for selectively producing a desired crown on the concrete being so formed, said crown forming means including a left segment pivotally attached on an inner portion thereof, along an axis generally parallel to said longitudinal centerline of said movable frame means, said crown forming means also including a right segment pivotally attached on an inner portion thereof, along an axis generally parallel to said longitudinal centerline of said movable frame means;

transition adjusting means for selectively raising and lowering said inner ends of said right and left segments for controlling said crown forming means;

means for generating a first signal indicative of the travel distance of the machine;

a first transition adjuster sensing means for generating a second signal for indicating the height of said transition adjusting means;

means for generating a third signal corresponding to the setting of a first crown height for said transition adjusting means;

means for generating a fourth signal corresponding to the setting of the second crown height for said transition adjusting means;

means for generating a fifth signal corresponding to the setting of the transition distance between said first and second crown heights of said transition adjusting means;

computer control means for automatically adjusting the position of the transition adjusting means for causing a smooth transition between two crown heights at two respective positions of said movable frame means as said movable frame means moves in said first direction in response to said first, second, third, fourth and fifth signals; and means for operably connecting said first, second, third, fourth and fifth signal generating means to said computer means, said method comprising the steps of:

(A) over a first section of concrete to be formed, processing the concrete with said apparats to form a crown having a first set of predetermined parameters as defined by the third, fourth and fifth signals;

(B) over a second section of concrete to be formed, which second section of concrete is substantially contiguous with the first section of concrete: using said apparats by automatically gradually adjusting the processing of a part of the second section of the concrete to form a crown having a second set of predetermined parameters as defined by the third, fourth and fifth signals, wherein at least one of the predetermined parameters is smoothly varied; and (C) over a third section of concrete to be formed, which third section of concrete is substantially contiguous with the second section of concrete: using said apparats to process the third section of the concrete to form a crown having a third set of predetermined parameters as defined by the third, fourth and fifth signals, wherein at least one parameters of the third set of predetermined parameters is different from a corresponding parameter of the first set of predetermined parameters, such that a crown formed in the first section of concrete will smoothly change in the second section of concrete into the crown formed in the third section of concrete.

9. Apparatus for automatically slip forming concrete comprising:

a movable frame means for moving in a first direction over concrete to be formed into a desired shape, said movable frame means having a longitudinal centerline generally parallel to said first direction;

crown forming means attached to said frame for selectively producing a desired crown on the concrete being so formed, said crown forming means including a left segment pivotally attached on an inner portion thereof, along an axis generally parallel to said longitudinal centerline of said movable frame means, said crown forming means also including a right segment pivotally attached on an inner portion thereof, along an axis generally parallel to said longitudinal centerline of said movable frame means;

transition adjusting means for selectively raising and lowering said inner ends of said right and left segments for controlling said crown forming means;

encoder means for generating a first signal to indicate the distance said frame means has traveled;

a first transition adjuster sensing means for generating a second signal for indicating the height of said transition adjusting means;

means for generating a third signal corresponding to the setting of a first crown height for said transition adjusting means;

means for generating a fourth signal corresponding to the setting of a second crown height for said transition adjusting means;

means for generating a fifth signal corresponding to the setting of the transition distance between said first and second crown heights of said transition adjusting means;

computer control means for automatically adjusting the position of the transition adjusting means for causing a smooth transition between two crown heights at two respective positions of said movable frame means as said movable frame means moves in said first direction in response to said first, second, third, fourth and fifth signals; and means for operably connecting said first, second, third, fourth, and fifth signal generating means to said computer means.

* * * * *